US005431753A

United States Patent [19]

Kim et al.

[11] Patent Number: 5,431,753

[45] Date of Patent: Jul. 11, 1995

[54] MANUFACTURING PROCESS FOR AUSTENITIC HIGH MANGANESE STEEL HAVING SUPERIOR FORMABILITY, STRENGTHS AND WELDABILITY

[75] Inventors: Tai W. Kim; Jae K. Han; Rae W. Chang, all of Pohang; Young G. Kim, Seoul, all of Rep. of Korea

[73] Assignees: Pohang Iron & Steel Co. Ltd.; Research Institute of Industrial Science & Techology, both of Book, Rep. of Korea

[21] Appl. No.: 107,826

[22] PCT Filed: Dec. 29, 1992

[86] PCT No.: PCT/KR92/00082

§ 371 Date: Aug. 26, 1993

§ 102(e) Date: Aug. 26, 1993

[87] PCT Pub. No.: WO93/13233

PCT Pub. Date: Jul. 8, 1993

[30] Foreign Application Priority Data

Dec. 30, 1991 [KR] Rep. of Korea ..... 1991-25112
Jul. 24, 1992 [KR] Rep. of Korea ..... 1992-13309

[51] Int. Cl.[6] ..... C21D 8/00
[52] U.S. Cl. ..... 148/620
[58] Field of Search ..... 420/72; 148/620

[56] References Cited

U.S. PATENT DOCUMENTS 4,830,686 5/1989 Hashiguchi et al. ..... 148/320
4,847,046 7/1989 Kim et al. ..... 420/76
4,854,976 8/1989 Era et al. ..... 148/2
4,956,025 9/1990 Koyama et al. ..... 148/12
4,968,357 11/1990 Liu ..... 148/620
5,078,809 1/1992 Kinoshita et al. ..... 148/12

FOREIGN PATENT DOCUMENTS 60-36647 2/1985 Japan ..... 420/72
61-288052 12/1986 Japan .
62-136557 6/1987 Japan .
63-35758 2/1988 Japan .
63-235428 9/1988 Japan ..... 148/620
64-17819 1/1989 Japan .

*Primary Examiner*—Deborah Yee
*Attorney, Agent, or Firm*—Webb Ziesenheim Bruening Logsdon Orkin & Hanson

[57] ABSTRACT

An austenitic high manganese steel having superior formability, strengths and weldability, and a process for manufacturing the steel, are disclosed. The superior formability of the steel is suitable for use on automobiles and electronic panel. The steel has a composition of (in weight %) less than 1.5% of C, 15.0–35.0% of Mn, 0.1–6.0% of Al, and the balance of Fe and other indispensable impurities. The size of the austenite grains is less than 40.0 μm, and, one or more elements are added by selecting them from a group consisting of less than 0.60% of Si, less than 5.0% of Cu, less than 1.0% of Nb, less than 0.5% of V, less than 0.5% of Ti, less than 9.0% of Cr, less than 4.0% of Ni, and less than 0.2% of N, thereby providing an austenitic high manganese steel having superior formability, strengths and weldability.

3 Claims, 5 Drawing Sheets

MANUFACTURING PROCESS FOR AUSTENITIC HIGH MANGANESE STEEL HAVING SUPERIOR FORMABILITY, STRENGTHS AND WELDABILITY

FIELD OF THE INVENTION

The present invention relates to an austenitic high manganese steel which is used in fields requiring a high formability such as automobile steel sheet, electronic panel sheet, and the like. Particularly the present invention relates to an austenitic high manganese steel having a good formability, high strengths and superior weldability.

BACKGROUND OF THE INVENTION

In the application field of steel, those which require best formability are automobile steel sheets, and electronic panel sheets.

Particularly, in the automobile industry, the discharge of carbon dioxide is more strictly regulated coming recently for alleviating the air pollution. In accordance with this trend, there has been demanded a high strength steel sheet which has a good formability, as well as improving the combustion rate of the fuel, and reducing the weight of the automobile.

Conventionally, as the automobile steel sheet, a extra low carbon steel in which the matrix structure is a ferrite has been used for assuring the formability (U.S. Pat. Nos. 4,950,025, 4,830,686 and 5,078,809).

However, in the case where the extra low carbon steel is used for the automobile steel sheet, although the formability is superior, the tensile strength is lowered to 28–38 kg/mm$^2$. Consequently the weight of the automobile cannot be reduced, and the safety of the automobile is lowered, thereby jeopardizing the lives of passengers.

The extra low carbon steel having the fenite matrix ferrite can include up to 0.005% of carbon, and the solubility limit for impurities is very low. If carbon and other impurities are added in excess of the solubility limit, then carbides and oxides are formed, with the result that particular textures cannot be developed during cold rolling and annealing processes, thereby degrading the formability.

Thus, in the case of the conventional automobile steel sheet having the fenite matrix, the addition of carbon is reduced to about 0.003%, as well as reducing other impurities to extremely small amounts for enhancing the formability. Consequently, there are accompanied difficulties such that special treatment such as degassing treatment has to be carried out in the steel making process, and that particular textures have to be developed during cold rolling and annealing processes.

Further, a multi-phase steel in which the low strengths of the extra low carbon steel are improved is disclosed in U.S. Pat. No. 4,854,976. In this steel, Si, Mn, P, Al and B are added in large amounts to form a bainite structure and retained austenite structure of less than 8%, thereby increasing the tensile strength to 50–70 kg/mm$^2$. However, due to the difference of the deformation capabilities between the bainite structure and the retained austenite structure, the formability is lowered, and therefore, this material is limitedly used in automobile parts which do not require a high formability.

Meanwhile, the steel sheet which is used as the external panel of electronic apparatus has to be non-magnetic material which is not influenced by magnetic fields, as well as being high in its strengths and formability. Therefore, austenitic stainless steel is mainly used for this purpose, but this steel contains expensive nickel to about 8%, while its magnetic susceptibility becomes unstable due to strain-induced $\alpha'$-martensites during its manufacturing process.

The present inventors have been engaged for many years in studying on how to overcome the disadvantages of the conventional automobile steel sheet and the electronic steel sheet, and have successfully developed an austenitic high manganese steel having superior formability and strengths.

So far, no case has been found in which a high manganese steel is used to attempt providing good formability and high strength.

Currently, the high manganese steel is used in nuclear fusion reactor, in magnetic floating rail for the purpose of preventing electrostatic charges, and as non-magnetic structural material for transformers (Japanese Patent Laying-opening No. Sho-63-35758, 64-17819, 61-288052 and 60-36647). Further, this material is also used as non-magnetic steel for some parts of VTR and electronic audio apparatuses (Japanese Patent Laying-opening No. Sho-62-136557).

However, in this non-magnetic high manganese steel, either Al as an ingredient of the alloy is not added, or it is added up to only 4% for deoxidizing, oxidation resistance, corrosion resistance, solid solution hardening, and grain refinement (Japanese Patent Laying-opening No. Sho-60-36647, 63-35758, and 62-136557)

Meanwhile the alloy of the same composition system which is related to the present invention is disclosed in Korean Patent 29304 (the corresponding U.S. Pat. No. 4,847,046, and Japanese Patent 1,631,935) which is granted to the present inventors).

However, the alloy system which is disclosed in Korean Patent 29304 is considered on its ultra low temperature strength and toughness, and therefore, is for being used in the cryogenic applications. Therefore, it is essentially different from the steel of the present invention which is intended to improve the formability, strengths and weldability.

SUMMARY OF THE INVENTION

Therefore, it is an object of the present invention to provide an austenitic high manganese steel and a manufacturing process thereof, in which the fact that an austenitic Fe—Mn—Al—C steel having a face centered cubic lattice has a high elongation is utilized to produce a proper amount of strain twins, thereby improving the formability, strengths and weldability.

It is another object of the present invention to provide an austenitic high manganese steel and a process for preparation thereof, in which a solid solution hardening element is added into an austenitic Fe—Mn—Al—C having a face centered cubic lattice, so that the strain twins should further improve the formability, strength and weldability.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENTS

Figure 1:
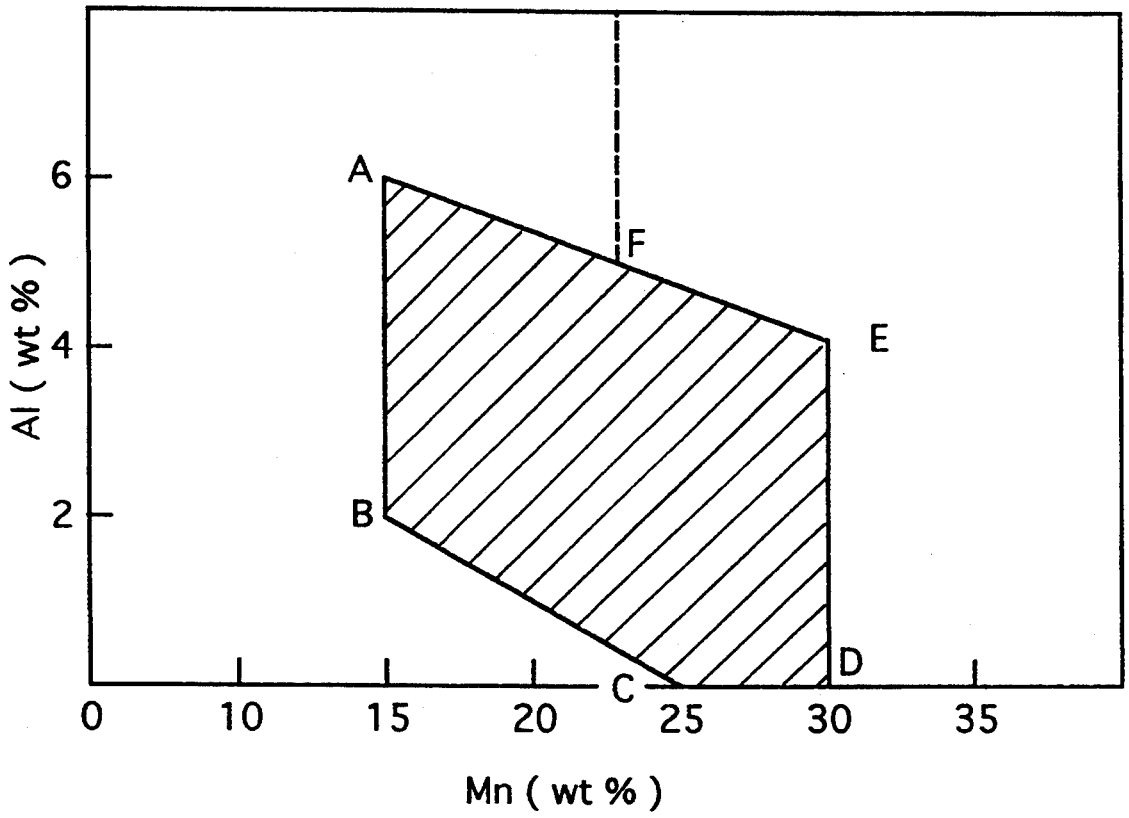
FIG. 1 is a graphical illustration showing the addition ranges of Mn and Al.

The steel of the present invention contains less than 0.70 weight % of C, and Mn and Al are added so as to come within the range which is enclosed by A, B, C, D and E in FIG. 1. The remaining part consists of Fe and other indispensable impurities, thereby forming an austenitic high manganese steel which has superior formability, strengths and weldability.

After a long study and experiments, the present inventors found that, even if the C, Mn and Al of the austenitic high manganese steel is varied to a certain degree, and even if the solid solution hardening element is added, still a high manganese steel having superior formability, strengths and weldability can be obtained. Based on this fact, a new invention is embodied, and this new invention will be described in detail below.

The steel of the present invention is composed of in weight % less than 1.5% of C, 15.0–35.0% of Mn, and 0.1–6.0% of Al, the balance consisting of Fe and other indispensable impurities. The grain size is 40.0 μm, and the formability, strengths and weldability are superior.

In another embodiment, the steel of the present invention is composed of in weight % less than 1.5% of C, 15.0–35.0% of Mn, 0.1–6.0% of Al, and one or more selected from the group consisting of less than 0.60% of Si, less than 5.0% of Cu, less than 1.0% of Nb, less than 0.5% of V, less than 0.5% of Ti, less than 9.0% of Cr, less than 4.0% of Ni, and less than 0.12% of N. The balance includes Fe and other indispensable impurities while the grain size is smaller than 40.0 μm, thereby providing an austenitic high manganese steel having superior formability, strength and weldability.

The high manganese steel of the present invention is hot-rolled and cold-rolled sequentially.

The manufacturing process of the steel of the present invention consists of such that a steel slab containing in weight % less than 1.5% of C, 15.0–35.0% of Mn, 0.1–6.0% of Al, and the balance of Fe and other indispensable impurities is prepared, and the steel slab is hot-rolled to hot rolled steel sheet in the normal method. Or the hot rolled steel sheet is cold rolled, and then, it is annealed at a temperature of 500°–1000° C. for 5 seconds to 20 hours, thereby obtaining an austenitic high manganese steel having superior formability, strengths and weldability.

Alternatively, the manufacturing process of the steel of the present invention consists of such that a steel slab is prepared, the slab containing in weight % less than 1.5 of C, 15.0–35.0 of Mn, 0.1–6.0 of Al, and one or more elements selected from the group consisting of less than 0.60% of Si, less than 5.0% of Cu, less than 1.0% of Nb, less than 0.5% of V, less than 0.5% of Ti, less than 9.0% of Cr, less than 4.0% of Ni, and less than 0.2% of N. The balance consists of Fe and other indispensable impurities, and this Slab is hot-rolled to hot rolled steel sheet as the final product. Or alternatively the hot rolled steel sheet is cold-rolled, and then, it is annealed at a temperature of 550°–1000° C. for 5 seconds to 20 hours, thereby obtaining an austenitic high manganese steel having superior formability, strengths and weldability.

Now the reason for the selection of the alloying elements and the addition ranges will be described.

The carbon (C) inhibits the formation of e-martensites by increasing the stacking fault energy, and improves the stability of the austenite. However, if its content is over than 1.5 weight % ( to be called %), its stacking fault energy becomes too high, with the result that no twins can be formed. Further, the solubility limit of carbin in the austenite is exceeded, with the result that carbides are excessively precipitated, thereby deteriorating the elongation and formability. Thus the content of carbon should be desirably less than 1.5%.

The manganese (Mn) is an indispensable element for improving the strengths and for stabilizing the austenite phase. However, if its content is less than 15.0%, an $\alpha'$-martensite phase come to exist, while if its content is over 35.0%, the formation of twins is inhibited because its addition effect is annulled. Therefore the content of manganese should be desirably confined within 15.0–35.0%.

The aluminum (Al) like the carbon heightens the stacking fault energy to stabilize the austenite phase, and does not form $\epsilon$-martensites even under a severe deformation such as cold rolling, but contributes to forming twins. Thus the aluminum is an important element for improving the cold workability and press formability. However, if its content is less than 0.1%, $\epsilon$-martensites are formed to deteriorate the elongation, although its strengths are reinforced, with the result that cold workability and press formability are deteriorated. Meanwhile, if its content exceeds 6.0%, the stacking fault energy is too much augmented, so that a slip deformation occurs due to a perfect dislocation. Therefore, the content of aluminum should be desirably 0.1–6.0%.

As described above, the addition of manganese and aluminum inhibits the formation of $\alpha'$-martensites, and excludes the possibility of the formation of $\epsilon$-martensites and slip deformations due to a perfect dislocation. Thus the two elements are limited so as for twins to be formed owing to partial dislocations.

The Si is an element added to deoxidze and to improve strengths by solution-hardening. If its content is over 0.6%, the deoxidizing effect is saturated, and the paint coatability is deteriorated during the manufacturing of cars, while cracks are formed during welding. Therefore the content of Si should be desirably limited to below 0.60%.

The Cu is an element to be added for the improvement of corrosion resistance and the increase of strengths through a solid solution hardening. If its content is over 5.0%, a hot brittleness occurs so as for hot rolling to be impaired. Therefore the content of Cu should be desirably limited to below 5.0%.

The Nb, V and Ti are elements to be added for improving strengths through a solid solution hardening. If the content of Nb is over 1.0%, cracks are formed during hot rolling, while if the content of V is over 0.5%, low melting point chemical compounds are formed, thereby impairing hot rolling quality. Meanwhile, the Ti reacts with nitrogen within the steel to precipitate nitrides, and consequently, twins are formed, thereby improving strengths and formability. However, if its content is over 0.5%, excessive precipitates are formed, so that small cracks should be formed during cold rolling, as well as aggravating formability and weldability. Therefore, the contents of Nb, V and Ti should be limited to respectively 1.0%, 0.5% and 0.5%.

The Cr and Ni are elements to be added for inhibiting the formation of $\alpha'$-martensite by stabilizing the austenite phase, and for improving strengths through a solid solution hardening. If the content of Cr is less than 9.0%, the austenite phase is stabilized, and prevents the formation of cracks during the heating of slab and during hot rolling, thereby improving the hot rollability. However, if its content is over 9.0%, $\alpha'$-martensites are produced in large amounts, thereby deteriorating the formability. Therefore, the content of Cr should be desirably limited to below 9.0%. The Ni improves elongation, and also improves mechanical properties such as impact strength. However, if its content exceeds 4.0% its addition effect is saturated, and therefore, its content should be desirably limited to 4.0% by taking into account the economic aspect.

The nitrogen (N) precipitates nitrides in reaction with Al in the solidification stage, during the hot rolling stage, and during the annealing stage after the cold rolling, and thus, performs a core role in producing twins during the press forming of steel sheets, thereby improving the formability and strengths. However, if its content exceeds 0.2%, the nitrides are precipitated in an excessive amount, thereby aggravating the elongation and the weldability. Therefore, the content of N should be desirably limited to below 0.2%.

Now the present invention will be described as to its manufacturing conditions.

The steel which has the above described composition undergoes a number of processes such as melting, continuous casting (or ingot casting) and hot rolling. As a result, a hot rolled steel plate having a thickness of 1.5–8 mm are obtained to be used on trucks, buses and other large vehicles.

This hot rolled steel sheet is cold-rolled and annealed into a cold rolled sheet of below 1.5 mm to be used mainly for motor vehicles. As to the annealing heat treatment, either continuous annealing heat treatment or box annealing heat treatment is possible. However, the continuous annealing heat treatment is preferable because of its economical feature in mass production.

The hot rolling for the steel of the present invention is carried out in the normal manner, and preferably, the slab reheating temperature should be 1100°–1250° C., while the finish hot rolling temperature should be 700°–1000° C. The above mentioned hot rolling temperature of 1100°–1250° C. is adopted so that the slab should be uniformly heated within a short period of time in order to improve the energy efficiency. If the hot rolling finish temperature is too low, the productivity is diminished, and therefore, its lower limit should be 700° C. The upper limit of the hot rolling finish temperature should be 1000° C., because over 10 rolling passes have to be undergone during the hot rolling process.

The cold rolling is also carried out in the normal manner. In manufacturing the Fe—Mn—Al—C steel, if the annealing temperature is below 500° C., then deformed austentic grains cannot be sufficiently recrystallized. Further, in this case, rolled elongated grains remain, and therefore, the elongation becomes too low, although the strengths are high. Meanwhile, if the annealing temperature is over 1000° C., austenite grains are grown into over 40.0 μm, with the result that the formability is lowered. Therefore the annealing temperature should be preferably limited to 500°–1000° C.

If the annealing time is less than 5.0 seconds, the heat cannot reach to the inner portion of the cold rolled sheet, with the result that complete recrystallizations cannot be formed. Further, in this case, the cold rolled grains remain, so that the formability should be impaired. Meanwhile, if the annealing time exceeds 20 hours, the time limit is violated to form coars carbides, thereby lowering the strengths and the formability. Therefore the annealing time should be preferably limited to 5 seconds to 20 hours.

In the case where the Fe—Mn—Al—C steel is manufactured by adding a solid solution hardening element, it is desirable to limit the annealing temperature and the annealing time to 550°–1000° C. and to 5.0 seconds to 20 hours respectively for the same reason described above.

The hot rolled steel sheet which is manufactured through the stages of alloy design—melting—continuous casting—hot rolling according to the present invention is cold rolled and annealed, so that the size of the austenite grains should be less than 40 μm, the tensile strength should be over 50 kg/mm$^2$, and the elongation should be over 40%.

In the steel of the present invention, if the grain size is over 40 μm, the formability is aggravated, and therefore, an adjustment for the annealing should be made in order to reduce the grain size to be smaller than 40 μm.

Now the present invention will be described further in detail based on actual examples.

<Example 1>

A steel having the composition of Table 1 below Was melted in vacuum, and then, steel ingots of 30 kg were formed. Then a solution treatment was carried out, and then, a slab rolling was carried out to form slabs having a thickness of 25 mm.

The slab manufactured in the above described manner was heated to a temperature of 1200° C., and a hot rolling was carried out, with the finish rolling temperature being 900° C. A hot rolled plate of a thickness of 2.5 mm was produced by this hot rolling process, and then, this hot rolled plate was cold rolled into a thickness of 0.8 mm.

The cold rolled sheet was annealed at a temperature of 1000° C. for 15 minutes, and an X-ray diffraction test was carried out on each of the test pieces. Then the volume fraction of the phases at the room temperature was observed, and this is shown in Table 1 below. Further, the permeability of the each of the test pieces was measured, this being shown also in Table 1 below.

Further, tensile tests were carried out on the test pieces for tensile strength, yield strength and elongation. Further, the uniformloy elongated portion of the tensile specimen after the tensile tests was cut out, and an X-ray diffraction test was carried out on the portion to measure volume fractions of strain-induced phase, this data being shown in Table 2 below.

TABLE 1

| Steel type | Chemical composition(weight %) C | Mn | P | S | Al | Ti | Cr | Ni | Volume fractions of the phases γ (austenite) | ε martensite | α'-martensite | Peameability (H = 10000e) |
|---|---|---|---|---|---|---|---|---|---|---|---|---|
| Steel of the invention | | | | | | | | | | | | |
| 1 | 0.64 | 15.5 | — | — | 3.0 | — | — | — | 100 | — | — | 1.0003 |
| 2 | 0.38 | 17.9 | — | — | 3.3 | — | — | — | 100 | — | — | 1.0003 |
| 3 | 0.27 | 19.1 | — | — | 3.2 | — | — | — | 100 | — | — | 1.0003 |
| 4 | 0.36 | 19.1 | — | — | 3.6 | — | — | — | 100 | — | — | 1.0003 |
| 5 | 0.13 | 22.7 | — | — | 1.9 | — | — | — | 100 | — | — | 1.0003 |
| 6 | 0.13 | 23.0 | — | — | 4.0 | — | — | — | 100 | — | — | 1.0003 |
| 7 | 0.47 | 23.1 | — | — | 3.5 | — | — | — | 100 | — | — | 1.0003 |
| 8 | 0.07 | 23.8 | — | — | 1.1 | — | — | — | 100 | — | — | 1.0003 |
| 9 | 0.34 | 24.8 | — | — | 1.3 | — | — | — | 100 | — | — | 1.0003 |
| 10 | 0.13 | 25.3 | — | — | 0.3 | — | — | — | 100 | — | — | 1.0003 |
| 11 | 0.12 | 27.2 | — | — | 3.1 | — | — | — | 100 | — | — | 1.0003 |
| 12 | 0.43 | 28.7 | — | — | 0.5 | — | — | — | 100 | — | — | 1.0003 |
| comparative steel | | | | | | | | | | | | |
| 13 | 0.06 | 14.4 | — | — | 2.8 | — | — | — | 61.4 | 10.3 | 18.3 | 78 |
| 14 | 0.22 | 15.6 | — | — | 0.05 | — | — | — | 71.6 | 12.6 | 15.8 | 66 |
| 15 | 0.19 | 19.6 | — | — | 0.01 | — | — | — | 91.6 | 8.4 | — | 1.0003 |
| 16 | 0.10 | 20.8 | — | — | 6.7 | — | — | — | 75 | — | 25 | 84 |
| 17 | 0.17 | 22.6 | — | — | 0.01 | — | — | — | 98.1 | 1.9 | — | 1.0003 |
| 18 | 0.11 | 29.7 | — | — | 4.8 | — | — | — | 100 | — | — | 1.0003 |
| 19 | 0.15 | 32.2 | — | — | 3.2 | — | — | — | 100 | — | — | 1.0003 |
| Convent. steel | | | | | | | | | | | | |
| 20 | 0.04 | 1.2 | 0.02 | 0.008 | — | — | 18.3 | 8.8 | 100 | — | — | 1.02 |
| 21 | 0.002 | 0.50 | 0.08 | 0.010 | 0.035 | 0.045 | — | — | — | — | 100α | 900 |

TABLE 2

| Steel type | Thickness | Tensile Test: Yield Strength (kg/mm²) | Tensile Strength (kg/mm²) | elongation (%) | Volume fractions of the phase after tensile tests (%): γ (austenite) | ε-martensite | α'-martensite |
|---|---|---|---|---|---|---|---|
| Steel of the invention | | | | | | | |
| 1 | 0.8 | 24.5 | 54.8 | 50.0 | 100 | — | — |
| 2 | " | 19.7 | 50.4 | 57.4 | 100 | — | — |
| 3 | " | 22.8 | 59.8 | 67.7 | 100 | — | — |
| 4 | " | 26.3 | 58.2 | 61.2 | 100 | — | — |
| 5 | " | 19.9 | 53.8 | 48.8 | 100 | — | — |
| 6 | " | 19.4 | 49.6 | 46.G | 100 | — | — |
| 7 | " | 24.7 | 55.2 | 43.5 | 100 | — | — |
| 8 | " | 18.6 | 58.5 | 58.6 | 100 | — | — |
| 9 | " | 22.8 | 65.4 | 59.6 | 100 | — | — |
| 10 | " | 19.0 | 50.4 | 52.8 | 100 | — | — |
| 11 | " | 20.6 | 50.7 | 42.4 | 100 | — | — |
| 12 | " | 26.4 | 55.7 | 43.9 | 100 | — | — |
| Comparative steel | | | | | | | |
| 13 | " | 21.8 | 66.1 | 20.4 | 48.8 | 25.9 | 25.3 |
| 14 | " | 29.0 | 83.8 | 14.0 | 44.1 | 13.7 | 42.2 |
| 15 | " | 32.2 | 91.7 | 19.7 | 81.1 | 18.9 | — |
| 16 | " | 25.5 | 51.5 | 37.0 | 52.4 | — | 47.6 |
| 17 | " | 26.1 | 82.4 | 29.1 | 65.8 | 34.2 | — |
| 18 | " | 21.5 | 53.0 | 37.2 | 100 | — | — |
| 19 | " | 19.0 | 46.0 | 36.8 | 100 | — | — |
| Convent. steel | | | | | | | |
| 20 | " | 23.5 | 65.5 | 79.2 | 80 | — | 20 |
| 21 | " | 19 | 38 | 42 | — | — | 100α |

As shown in Table 1 above, the steels 1–12 of the present invention did not form ε-martensites and α'-martensites, but only formed austenite phase, so that they should be non-magnetic steels.

Meanwhile, the comparative steels 13–17 which departs from the composition of the steel of the present invention in their manganese and aluminum formed α'-martensites to have magnetic properties, and or formed ε-martensites.

The conventional steel 20 and the comparative steels 18 and 19, which have larger amounts in manganese and aluminum compared with the composition of the present invention had austenitic single phase, and had no magnetic property. The conventional steel 21 which is usually extra low carbon steel had a ferrite phase ($\alpha$), and had magnetic properties.

On the other hand, in the case of the comparative steels 13–15 and 17, their tensile strength was high, but their elongation was very low. This is due to the fact that the contents of manganese and aluminum were too low, thereby producing $\epsilon$-martensites and $\alpha'$-martensites through a strain-induced transformation.

The comparative steel 16 showed a low elongation, and this is due to the fact that the content of aluminum was too high (although the content of manganese was relatively low), thereby forming $\alpha'$-martensites through a strain-induced transformation, with lack of twins.

The comparative steels 18–19 showed low tensile strength and low elongation, and this is due to the fact that manganese and aluminum were too much added, resulting in that there was produced no martensite through strain-induced transformation, as well as no twins.

Meanwhile, the conventional steel 20 which is the normal stainless steel showed a high tensile strength and a high elongation. However, it had magnetic properties due to the formation of $\alpha'$-martensites through a strain-induced transformation. Meanwhile, the conventional steel 21 which is a extra low carbon steel showed a tensile strength markedly lower than that of the steel 1–12 of the present invention, and this is due to the fact that the conventional steel 21 has a ferrite phase.

<Example 2>

Figure 2:
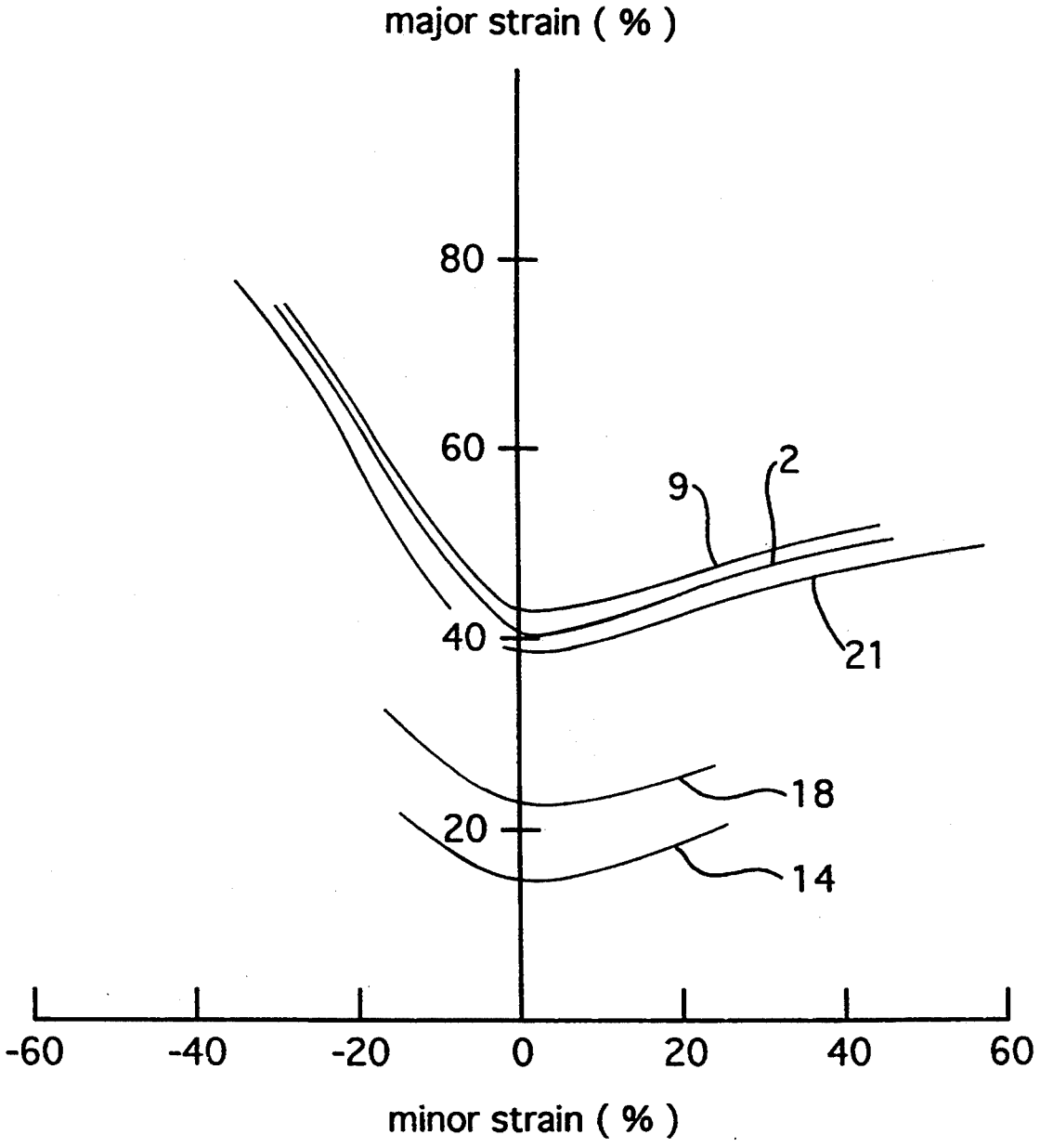
FIG. 2 is a graphical illustration showing the limits of the formability based on the experiments.

On the steels 2 and 9 of the present invention, on the comparative steels 14 and 18, and on the conventional steel 21 of Example 1, formability limit diagram tests were carried out, and the test results are shown in FIG. 2.

As shown in FIG. 2, the steels 2 and 9 of the present invention showed a superior formability compared with the conventional extra low carbon steel 21, because twins were formed in the former. The comparative steels 14 and 18 shows no acceptable formability because they did not form twins.

Meanwhile, as shown in Table 2, the steels 1–12 of the present invention, which meet the composition range of the present invention, showed a yield of 19–26 kg/mm$^2$, a tensile strength of 50–70 kg/mm$^2$ and a elongation of 40–68%. Particularly, the high elongation of the steels 1–12 of the present invention owes to the formation of twins through the tensile deformation. This fact can be confirmed by the electron micrograph of the steel 5 of the present invention as shown in FIG. 3.

Figure 3:
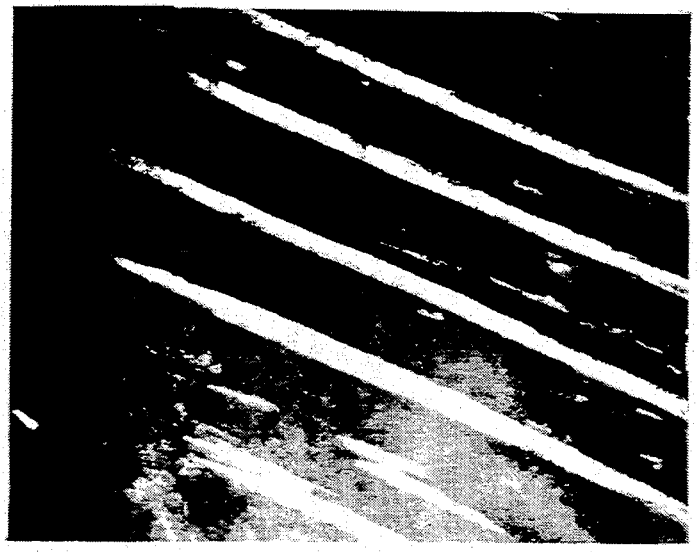
FIG. 3 is an electron micrograph showing the formation of strain twins in the steel of the present invention.

In FIG. 3, the white portion indicates twins, while the black portions (Matrix) indicate the austenite.

<Example 3>

A steel having the composition of Table 3 was melted under vacuum, and then, ingots of 30 kg were prepared from it. Then a solution treatment was carried out, and then, a slab rolling was carried out to form slabs of a thickness of 25 mm. This slab was heated to 1200° C., and a hot rolling was carried out, with the finish rolling temperature being 900° C., thereby producing hot rolled sheets of a thickness of 2.5 mm. A microstructure observation was carried out on the hot rolled sheets to measure the size of the austenite grains, and the results of these test are as shown in Table 3-A below.

Then the hot rolled sheets were subjected to measurements of yield strength, tensile strength and elongation. After such tests, a uniformly elongated portion of the tensile specimen after the tensile test was cut out to subject to an X-ray diffraction test, thereby measuring the volume fractions of the phases. The result of this test is shown in Table 3-A below.

TABLE 3

| Steel type | Chemical Composition(weight %) C | Mn | Al | P | S | Ti |
|---|---|---|---|---|---|---|
| Steel of the invention | | | | | | |
| 22 | 0.64 | 15.5 | 3.0 | — | — | — |
| 23 | 0.38 | 17.9 | 3.3 | — | — | — |
| 24 | 0.27 | 19.1 | 3.2 | — | — | — |
| 25 | 0.47 | 23.1 | 3.5 | — | — | — |
| 26 | 0.07 | 23.8 | 1.1 | — | — | — |
| 27 | 1.43 | 25.1 | 0.8 | — | — | — |
| 28 | 0.13 | 25.3 | 0.3 | — | — | — |
| 29 | 0.98 | 28.5 | 6.0 | — | — | — |
| 30 | 0.43 | 28.7 | 0.5 | — | — | — |
| 31 | 1.12 | 34.7 | 2.5 | — | — | — |
| Comparative steel | | | | | | |
| 32 | 0.06 | 14.4 | 2.8 | — | — | — |
| 33 | 0.19 | 19.6 | 0.01 | — | — | — |
| 34 | 0.10 | 20.8 | 6.7 | — | — | — |
| 35 | 0.17 | 22.6 | 0.02 | — | — | — |
| 36 | 1.60 | 33.1 | 1.7 | — | — | — |
| 37 | 0.60 | 37.0 | 3.3 | — | — | — |
| Convent. steel 38 | 0.002 | 0.50 | 0.035 | 0.08 | 0.010 | 0.045 |

TABLE 3-A

| Steel Sheet No. | Thickness (mm) | Austenite Grain Size (μm) | Tensile Test: Yield Strength (kg/mm$^2$) | Tensile Strength (kg/mm$^2$) | Elongation (%) | Volume fractions of the phases after the tensile tests: $\gamma$ (austenite) | $\epsilon$-martensite | $\alpha'$-martensite | Steel Type |
|---|---|---|---|---|---|---|---|---|---|
| Hot rolled sheet of the invention | | | | | | | | | Steel of the invention |
| 22 | 2.5 | 34 | 26.4 | 56.2 | 50.7 | 100 | — | — | 22 |
| 23 | " | 35 | 21.2 | 54.4 | 54.6 | " | — | — | 23 |
| 24 | " | 29 | 25.6 | 59.9 | 61.8 | " | — | — | 24 |
| 25 | " | 30 | 30.1 | 69.6 | 41.5 | " | — | — | 25 |
| 26 | " | 30 | 21.3 | 61.5 | 55.8 | " | — | — | 26 |
| 27 | " | 32 | 33.4 | 70.1 | 40.3 | " | — | — | 27 |
| 28 | " | 35 | 21.9 | 54.6 | 50.7 | " | — | — | 28 |
| 29 | " | 30 | 28.1 | 63.2 | 40.8 | " | — | — | 29 |
| 30 | " | 33 | 27.4 | 57.0 | 43.1 | " | — | — | 30 |
| 31 | " | 34 | 29.7 | 67.4 | 41.7 | " | — | — | 31 |
| Comparative hot rolled sheet | | | | | | | | | Comparative Steel |
| 32 | " | 32 | 24.5 | 68.5 | 18.8 | 52.9 | 23.7 | 24.4 | 32 |
| 33 | " | 30 | 33.1 | 91.5 | 17.6 | 85.3 | 14.7 | — | 33 |

TABLE 3-A-continued

| Steel Sheet No. | Thickness (mm) | Austenite Grain Size (μm) | Tensile Test: Yield Strength (kg/mm²) | Tensile Strength (kg/mm²) | Elongation (%) | Volume fractions of the phases after the tensile tests: γ (austenite) | ε-martensite | α'-martensite | Steel Type |
|---|---|---|---|---|---|---|---|---|---|
| 34 | " | 31 | 27.1 | 54.7 | 37.4 | 100 | 13 | — | 34 |
| 35 | " | 34 | 28.4 | 69.2 | 27.5 | 90.6 | 9.4 | — | 35 |
| 36 | " | 30 | 33.4 | 72.2 | 26.4 | 100 | — | — | 36 |
| 37 | " | 35 | 28.6 | 58.5 | 34.4 | 100 | — | — | 37 |

As shown in Table 3-A above, the hot rolled steel sheets 22–31 which were manufactured according to the composition range and the hot rolling conditions of the present invention showed superior properties. That is, they showed a tensile strength of 54–70 kg/mm² and a elongation of over 40%, and this owes to the fact that deformation twins were formed as a result of tensile deformation.

After the tensile tests, the steels 22–31 all showed an austenitic single phase, and the lattice structure of the deformation twins was of face centered cubic structure corresponding to that of the austenite phase, with the result that they cannot be distinguished through an X-ray diffraction test.

On the other hand, in the case of the hot rolled comparative steels 32, 33 and 35, the tensile strength showed high, but the elongation was low. This is due to the fact that the contents of manganese and aluminum were too low, resulting in that ε-martensites and α'-martensites were formed through a strain-induced transformation.

The comparative hot rolled steels 34 and 37 showed a low tensile strength and a low elongation, and this is due to the fact that the contents of manganese and aluminum were too high, so that not only the formation of martensite through a strain-induced transformation could not occur, but also twins could not be formed.

Meanwhile, the comparative hot rolled sheet 36 showed a high yield strength and a high tensile strength, but a low elongation, and this is due to the fact that the content of the carbon was to high so as for carbides to be precipitated too much.

Further, the hot rolled steel sheets were cold rolled to a thickness of 0.8 mm, and this cold rolled steel sheets were annealed at a temperature of 1000° C. for 15 minutes. Then on each of the test pieces, a microstructure observation was carried out to measure the austenite grain size. Then tensile tests were carried to measure yield strength, tensile strength and elongation. Further, a uniformly elongazted portion of the tensile specimen after the tensile tests was cut out to subject it to an X-ray diffraction test. In this way, the volume fractions of the phases was measured, and the result of the measurements are shown in Table 3-B below.

Figure 4:
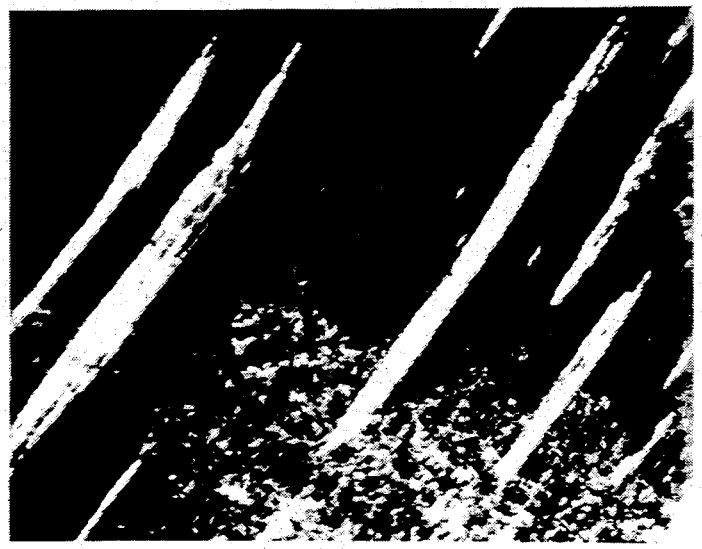
FIG. 4 is an electron micrograph showing the formation of deformation twins in another embodiment of the present invention.

Further, the steel 24 of the present invention as listed in Table 3-B was observed by an electron microscope, the result of the observation being shown in FIG. 4.

TABLE 3-B

| Steel Type | Thickness (mm) | Austenite Grain Size after annealing (μm) | Tensile test: Yield Strength (kg/mm²) | Tensile Strength (kg/mm²) | elongation (%) | Volume Fractions of the Phases: γ (austenite) | ε-martensite | α'-martensite | Remarks |
|---|---|---|---|---|---|---|---|---|---|
| Steel of the invention | | | | | | | | | Hot rolled steel sheet of the invention |
| 22 | 0.8 | 35 | 24.5 | 54.8 | 50.0 | 100 | — | — | 22 |
| 23 | " | 38 | 19.7 | 50.4 | 57.4 | " | — | — | 23 |
| 24 | " | 34 | 22.8 | 56.8 | 67.7 | " | — | — | 24 |
| 25 | " | 31 | 29.7 | 68.2 | 43.5 | " | — | — | 25 |
| 26 | " | 37 | 18.6 | 58.5 | 58.6 | " | — | — | 26 |
| 27 | " | 39 | 31.3 | 70.4 | 41.0 | " | — | — | 27 |
| 28 | " | 36 | 19.0 | 50.4 | 52.8 | " | — | — | 28 |
| 29 | " | 35 | 27.6 | 60.7 | 42.4 | " | — | — | 29 |
| 30 | " | 36 | 26.4 | 55.7 | 43.9 | " | — | — | 30 |
| 31 | " | 38 | 26.8 | 65.4 | 44.6 | " | — | — | 31 |
| Comparative steel | | | | | | | | | Comparative hot rolled steel sheet |
| 32 | " | 32 | 21.8 | 66.1 | 20.4 | 48.8 | 25.9 | 25.3 | 32 |
| 33 | " | 36 | 32.2 | 91.7 | 19.7 | 81.1 | 18.9 | — | 33 |
| 34 | " | 34 | 25.5 | 51.5 | 37.0 | 100 | — | — | 34 |
| 35 | " | 36 | 26.1 | 68.4 | 29.1 | 90.8 | 9.2 | — | 35 |
| 36 | " | 35 | 31.5 | 71.5 | 27.2 | 100 | — | — | 36 |
| 37 | " | 38 | 27.2 | 56.0 | 36.8 | 100 | — | — | 37 |
| Convent. Steel 38 | " | 65 | 19 | 38 | 42 | — | — | 100 | — |

As shown in Table 3-B above, the steels 22–31 of the present invention which meet the composition of the present invention had a tensile strength of 50–70 kg/mm² which is almost twice that of the conventional steel 38 which had a tensile strength of 38 kg/mm². Meanwhile, the elongation of the steels 22–31 showed to be over 40%, while the phase after the tensile tests showed to be an austenitic single phase.

On the other hand, the comparative steels 32, 33 and 35 showed a high tensile strength but a low elongation. This is due to the fact that the contents of manganese and aluminum were too low, resulting in that ε-martensites and α'-martensites were formed through a strain-induced transformation.

Meanwhile, the comparative steels 34 and 37 were low in both the tensile strength and in the elongation, and this is due to the fact that the contents of manganese and aluminum were too high, so that no martensite phase through a strain-induced transformation as well as twins could not be formed.

Meanwhile, the comparative steel 36 was high in its yield strength and tensile strength, but low in its elongation, and this is due to the fact that the content of carbon was too high so as to precipitate too much carbides.

Meanwhile, the conventional steel 38 which is a extra low carbon steel showed its tensile strength to be markedly lower than that of the steels of the present invention, and this is due to the fact that the steel 38 had a ferrite structure.

As described above, the steels 22–31 of the present invention which meet the composition of the present invention showed a yield strength of 19–31 kg/mm$^2$, a tensile strength of 50–7-kg/mm$^2$, and a elongation of 40–68%. Particularly, the high elongation of the steels 22–31 of the present invention owes to the formation of twins through the tensile deformation. This fact can be confirmed by the electron micrograph for the steel 24 of the present invention as shown in FIG. 4.

In FIG. 4, the white portion indicates twins, while the block portion indicates the austenite structure (matrix).

<Example 4>

Figure 5:
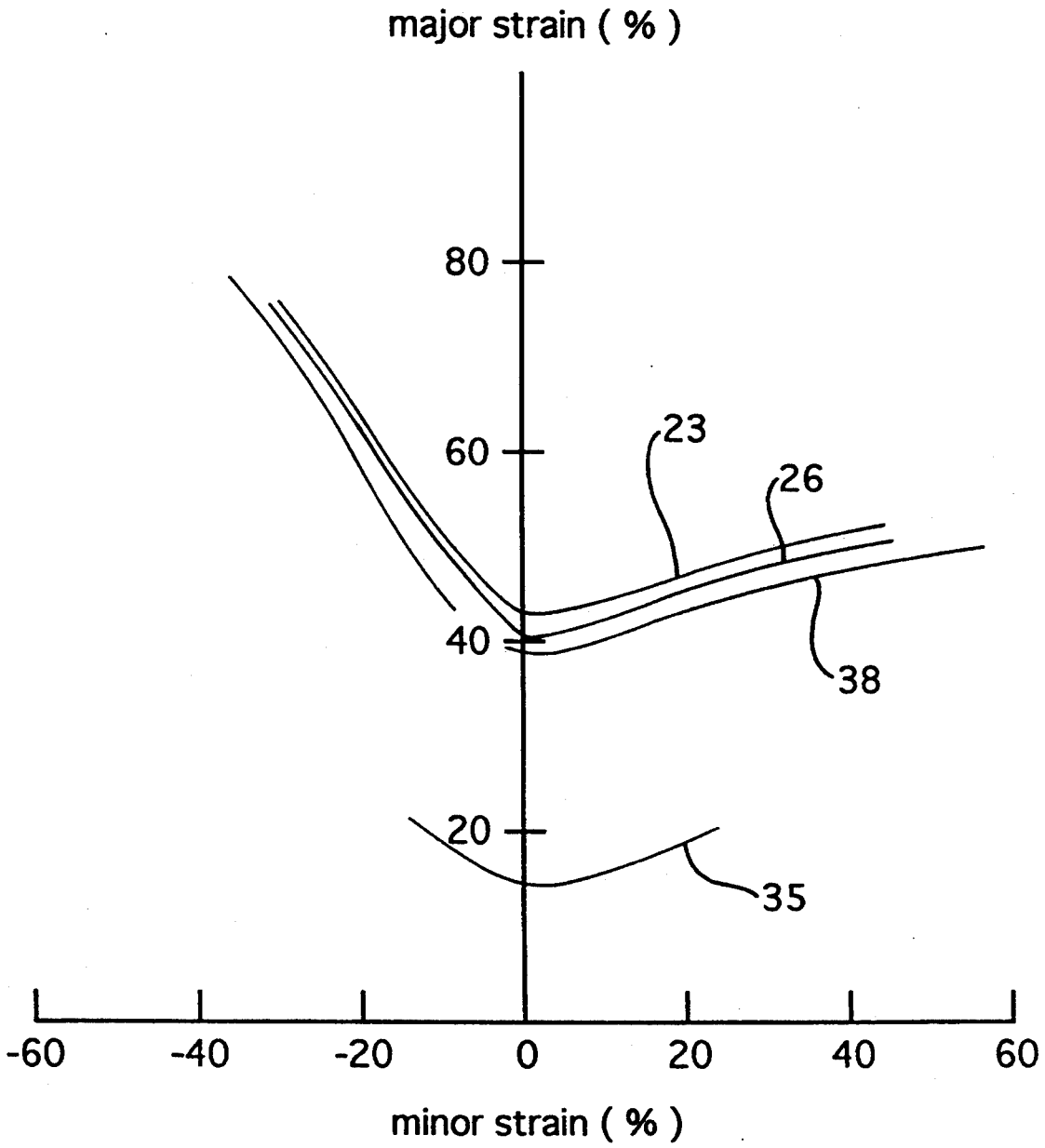
FIG. 5 is a graphical illustration showing the limit of the formability based on the experiments.

The formability limit tests were carried out on the steels 23 and 26, the comparative steel 35 and the conventional steel 38 of Example 3, and the result of the tests is shown in FIG. 5.

As shown in FIG. 5, the steels 23 and 26 showed the formability to be superior to that of the conventional steel 38 which is a extra low carbon steel, while the comparative steel 35 showed the formability worse than that of the conventional steel 38. This is due to the fact that, while the steels 23 and 26 of the present invention have a superior formability owing to the formation of twins, the comparative steel 35 forms ε-martensites, thereby aggravating the formability.

<Example 5>

A steel having the composition of Table 4 below was melted, and ingots of 30 kg were prepared from it. Then a solution treatment was carried out, and then, a slab rolling was carried out into slabs of a thickness of 25 mm.

Here in Table 4, the steels 39–40 of the present invention and the comparative steels 54–60 were melted in vacuum, while the comparative steel 61 and the steels 50–53 containing a large amount of nitrogen (N) were melted under the ordinary atmosphere.

The slab which was prepared in the above described manner was heated to a temperature of 1200° C., and was hot-rolled under a finish temperature of 900° C. to produce hot rolled steel sheets of a thickness of 2.5 mm. These hot rolled steel sheets were subjected to a microstructure inspection, thereby measuring the size of the austenite grains. The result of this inspection is shown in Table 4-A below.

Further, the hot rolled steel sheets were subjected to tensile tests to decide yield strength, tensile strength and elongation. After carrying out the tensile tests, the uniformly elongated portion of the tensile specimen was cut out to subject it to an X-ray diffraction test, thereby estimating the volume fractions of the phases. The results of these tests are shown in Table 4-A below.

TABLE 4

(Unit: weight %)

| Steel type | Composition | | | | | | | | | | |
|---|---|---|---|---|---|---|---|---|---|---|---|
| | C | Si | Mn | Al | Cr | Ni | Cu | Nb | V | Ti | N |
| Steel of the invention | | | | | | | | | | | |
| 39 | 0.13 | — | 16.1 | 5.5 | — | 3.9 | — | — | — | — | 0.005 |
| 40 | 0.94 | — | 19.7 | 3.7 | 7.2 | — | — | — | — | — | 0.005 |
| 41 | 0.44 | — | 20.3 | 5.6 | — | — | — | 0.2 | 0.4 | — | 0.006 |
| 42 | 0.35 | — | 22.5 | 1.8 | — | — | — | 0.3 | — | 0.07 | 0.009 |
| 43 | 0.08 | — | 24.6 | 3.6 | — | — | — | — | 0.3 | 0.14 | 0.009 |
| 44 | 1.18 | 0.16 | 27.4 | 1.5 | — | — | — | — | — | 0.15 | 0.009 |
| 45 | 1.35 | — | 27.8 | 2.2 | — | — | 2.7 | — | — | — | 0.006 |
| 46 | 0.37 | — | 29.5 | 3.3 | 1.2 | 1.4 | — | 0.1 | — | — | 0.007 |
| 47 | 0.28 | — | 32.3 | 2.1 | — | — | 0.4 | 0.1 | — | — | 0.006 |
| 48 | 0.63 | 0.08 | 32.8 | 0.34 | — | — | — | — | — | — | 0.006 |
| 49 | 0.13 | 0.22 | 33.5 | 1.2 | — | — | 2.8 | — | — | — | 0.005 |
| 50 | 0.53 | 0.05 | 26.4 | 3.7 | — | — | — | — | — | — | 0.19 |
| 51 | 0.45 | 0.05 | 27.4 | 1.2 | — | — | — | — | — | — | 0.09 |
| 52 | 0.35 | 0.07 | 35.0 | 1.2 | — | — | — | — | — | — | 0.08 |
| 53 | 0.40 | 0.20 | 26.5 | 2.3 | — | — | — | — | — | — | 0.10 |
| Comparative steel | | | | | | | | | | | |
| 54 | 0.12 | — | 16.1 | 2.7 | 10.2 | — | — | — | 0.07 | 0.09 | 0.006 |
| 55 | 0.13 | — | 19.3 | 1.4 | — | — | — | — | 0.61 | 0.44 | 0.007 |
| 56 | 0.16 | — | 24.4 | 5.4 | — | 4.6 | — | — | — | 0.51 | 0.007 |
| 57 | 0.24 | — | 27.4 | 4.7 | — | 0.4 | — | 1.3 | — | — | 0.006 |
| 58 | 0.13 | 0.16 | 30.1 | 0.3 | — | — | 6.4 | — | — | — | 0.006 |
| 59 | 0.75 | 0.35 | 32.9 | 3.3 | 1.8 | — | 2.5 | 1.1 | — | — | 0.008 |
| 60 | 1.27 | 0.97 | 36.6 | 5.2 | 0.5 | — | — | — | — | — | 0.006 |
| 61 | 0.44 | 0.05 | 27.2 | 2.3 | — | — | — | — | — | — | 0.23 |

TABLE 4-A

| Steel Sheet No. | Thickness (mm) | Austenite Grain Size (μm) | Tensile Test: Yield Strength (kg/mm²) | Tensile Strength (kg/mm²) | Elongation (%) | Volume fractions of the phases: γ (Austenite) | ε-Martensite | α'-Martensite | Remarks (Steel Type) |
|---|---|---|---|---|---|---|---|---|---|
| Hot rolled steel sheet of the invention | | | | | | | | | Steel of the Invention |
| 39 | 2.5 | 32 | 27.2 | 93.4 | 43.5 | 100 | — | — | 39 |
| 40 | " | 35 | 26.4 | 63.0 | 44.7 | " | — | — | 40 |
| 41 | " | 34 | 21.8 | 61.1 | 40.4 | " | — | — | 41 |
| 42 | " | 32 | 28.7 | 66.4 | 43.9 | " | — | — | 42 |
| 43 | " | 31 | 25.4 | 63.6 | 44.2 | " | — | — | 43 |
| 44 | " | 33 | 24.9 | 69.8 | 58.8 | " | — | — | 44 |
| 45 | " | 35 | 23.3 | 60.2 | 40.2 | " | — | — | 45 |
| 46 | " | 29 | 25.1 | 60.6 | 42.7 | " | — | — | 46 |
| 47 | " | 34 | 23.2 | 60.8 | 44.4 | " | — | — | 47 |
| 48 | " | 30 | 24.7 | 61.5 | 40.8 | " | — | — | 48 |
| 49 | " | 33 | 26.2 | 60.4 | 49.6 | " | — | — | 49 |
| 50 | " | 35 | 28.7 | 67.7 | 43.7 | " | — | — | 50 |
| 51 | " | 31 | 28.9 | 63.5 | 45.4 | " | — | — | 51 |
| 52 | " | 30 | 27.4 | 63.0 | 46.0 | " | — | — | 52 |
| 53 | " | 34 | 29.3 | 66.7 | 46.5 | " | — | — | 53 |
| Comparative hot rolled steel sheet | | | | | | | | | Comparative Steel |
| 54 | " | 35 | 33.1 | 90.7 | 15.4 | 89 | — | 11 | 54 |
| 55 | " | 34 | 27.5 | 68.3 | 17.9 | 100 | — | — | 55 |
| 56 | " | 32 | 25.6 | 64.5 | 29.5 | 100 | — | — | 56 |
| 57 | " | 32 | 24.7 | 61.5 | 25.8 | 100 | — | — | 57 |
| 58 | " | 31 | 23.4 | 60.8 | 35.3 | 100 | — | — | 58 |
| 59 | " | 30 | 21.6 | 62.9 | 30.7 | 100 | — | — | 59 |
| 60 | " | 36 | 20.7 | 63.4 | 28.2 | 100 | — | — | 60 |
| 61 | " | 34 | 26.8 | 69.7 | 25.5 | 100 | — | — | 61 |

As shown in Table 4-A, the hot rolled steel sheets 39–53 of the present invention showed a yield strength of 22–30 kg/mm², a tensile strength of 60–70 kg/mm², and a elongation of 40–60%.

Further, the hot rolled steel sheets 39–53 of the present invention had fine austenite grain sizes down to 40 μm, while they do not form ε-martensites and α'-martensites even after undergoing the tensile deformation, but holds fully austenite phase. The reason why the steels 39–53 of the present invention showed such a high elongation of over 40% is that twins were formed during the tensile deformation.

Of the steels of the present invention, the hot rolled steel sheets 39–46 and 48–53, in which large amounts of solid solution hardening elements such as Cr, Ni, Cu, Nb, V, Ti, N and the like were added, showed yield strengths and tensile strengths higher than those of the hot rolled steel sheet 47 of the present invention in which the solid solution hardening elements were added in smaller amounts. This is due to the fact that the addition of the solid solution hardening elements results in the increase of the strengths.

Further, of the steels of the present invention, the hot rolled steel sheets 50–53 of the present invention, in which nitrogen was added in a large amount, showed higher yield strengths and higher tensile strengths over those of the hot rolled steel sheets 39–49 in which nitrogen was added in a smaller amount. This is due to the fact that fine twins are formed during the deformation caused by the aluminum nitrides which were formed in the solidification stage, during the hot rolling stage and during the annealing heat treatment after the cold rolling.

Meanwhile, the comparative hot rolled steel sheets 58 and 60, in which Cu and Si were added in larger amounts over the composition of the present invention, showed an austenitic single phase, but their elongation is too low. This is due to the fact that non-metallic impurities and cracks formed during the rolling contributed to lowering the elongation.

Further, the comparative hot rolled steel sheets 55–57 and 59 in which Nb, V and Ti were added in amounts larger than the composition range of the present invention showed a low elongation, and this is due to the fact that the carbides were produced in large amounts within the steel to lower the elongation.

The comparative hot rolled steel sheet 54 which contained Cr in an amount larger than the composition range of the present invention showed high strengths, but its elongation was too low. This is due to the fact that a large amount of α'-martensites are formed after the tensile deformation.

The comparative hot rolled steel sheet 61 in which nitrogen (N) was contained in an amount larger than the composition range of the present invention showed a low elongation, and this may be due to the fact that nitrides were too much precipitated.

The hot rolled steel sheets which had been manufactured in the above described manner were cold-rolled to a thickness of 0.8 mm, and then, were annealed at a temperature of 1000° C. for 15 minutes. Then a microscopic structure observation was carried out to decide the size of the austenite grains, and then, the tensile tests such as yield strength, tensile strength and elongation were carried out. Then the uniformly elongated portion of the tensile specimen after the tensile test was cut out to decide the volume fractions of the phases, and then, a cupping test was carried out using a punch of a 33 mm diameter to measure the limit drawing ratio (LDR). The results of these tests are shown in Table 4-B below.

In Table 4-B below, the value of LDR is defined to be LDR=[diameter of blank]/[diameter of punch]. The standard LDR for automobile steel sheets in which a good formability is required is known to be 1.94. Resorting to this standard, the formability were evaluated based on whether a steel sheet has an LDR value over or below 1.94.

TABLE 4-B

| Steel Type | Thickness (mm) | Austenite Grain Size after annealing (μm) | Tensile test: Yield Strength (kg/mm²) | Tensile test: Tensile Strength (kg/mm²) | Tensile test: elongation (%) | Formability test LDR* value | Volume Fractions of the Phase: γ (Austenite) | Volume Fractions of the Phase: ε-Martensite | Volume Fractions of the Phase: α'-Martensite | Remarks |
|---|---|---|---|---|---|---|---|---|---|---|
| Steel of the invention | | | | | | | | | | Hot rolled steel sheet of the invention |
| 39 | 0.8 | 34 | 26.3 | 63.2 | 42.4 | 1.94 | 100 | — | — | 39 |
| 40 | " | 39 | 24.9 | 61.8 | 43.5 | " | 100 | — | — | 40 |
| 41 | " | 37 | 20.6 | 59.7 | 40.6 | " | 100 | — | — | 41 |
| 42 | " | 32 | 27.2 | 64.6 | 45.0 | " | 100 | — | — | 42 |
| 43 | " | 35 | 24.7 | 60.2 | 45.6 | " | 100 | — | — | 43 |
| 44 | " | 34 | 23.0 | 65.2 | 61.7 | " | 100 | — | — | 44 |
| 45 | " | 37 | 22.0 | 58.4 | 40.6 | " | 100 | — | — | 45 |
| 46 | " | 33 | 22.7 | 58.8 | 43.5 | " | 100 | — | — | 46 |
| 47 | " | 38 | 21.2 | 57.7 | 45.9 | " | 100 | — | — | 47 |
| 48 | " | 34 | 23.3 | 59.3 | 42.4 | " | 100 | — | — | 48 |
| 49 | " | 36 | 26.4 | 58.2 | 48.8 | " | 100 | — | — | 49 |
| 50 | " | 37 | 26.5 | 65.7 | 44.0 | " | 100 | — | — | 50 |
| 51 | " | 33 | 26.2 | 61.1 | 44.2 | " | 100 | — | — | 51 |
| 52 | " | 33 | 25.7 | 60.5 | 46.9 | " | 100 | — | — | 52 |
| 53 | " | 35 | 25.9 | 63.3 | 47.1 | " | 100 | — | — | 53 |
| Comparative steel | | | | | | | | | | Comparative hot rolled steel sheet |
| 54 | " | 35 | 32.7 | 91.3 | 14.0 | 1.94 or less | 87 | — | 13 | 54 |
| 55 | " | 36 | 26.1 | 67.8 | 19.7 | " | 100 | — | — | 55 |
| 56 | " | 32 | 24.3 | 62.8 | 30.4 | " | 100 | — | — | 56 |
| 57 | " | 36 | 24.2 | 60.7 | 27.5 | " | 100 | — | — | 57 |
| 58 | " | 34 | 22.6 | 58.6 | 37.1 | " | 100 | — | — | 58 |
| 59 | " | 35 | 20.8 | 62.8 | 31.8 | " | 100 | — | — | 59 |
| 60 | " | 39 | 19.4 | 61.3 | 28.6 | " | 100 | — | 100 | 60 |
| 60 | " | 36 | 26.4 | 67.6 | 27.5 | " | 100 | — | 100 | 61 |

*LDR value = $\frac{\text{Diameter of blank}}{\text{Diameter of punch}}$

As shown in Table 4-B, the steels 39–53 of the present invention showed a yield strength of 20–27 kg/mm², a tensile strength of 57–66 kg/mm² and a elongation of 40–60%.

Further, the steels 39–49 of the present invention did not form ε-martensites or α'-martensites, but showed an austenitic single phase structure, thereby forming a highly stable steel. Further, they had a elongation of over 40%, and also showed superior formability. This owes to the fact that twins are formed during the tensile deformation.

Among the steels of the present invention, the steels 39–46 and 48–53, in which the solid solution hardening elements such as Cr, Ni, Cu, Nb, V, Ti N and the like were added in large amounts, showed high yield strength and tensile strength over the steel 47 of the present invention in which the solid solution hardening elements were added in smaller amounts. This owes to the fact that the solid solution hardening elements resulted in the increase of the strengths.

Further, among the steels of the present invention, the steels 50–53, in which nitrogen was added in large amounts, showed higher yield strength and tensile strength over the steels 39–49 of the present invention in which nitrogen was added in smaller amounts. This owes to the fact that nitrides were precipitated in reaction with Al in the solidification stage, during the hot rolling stage and during the annealing heat treatment after the cold rolling, and that fine twins were formed during the deformation caused by the aluminum nitrides.

Meanwhile, the comparative steels 58 and 60 in which Cu and Si were added in excess of the composition range of the present invention showed an austenitic single phase, but their formability was not acceptable. This is due to the fact that the formability is aggravated by non-metallic impurities and fine cracks formed during the rolling.

Further, the comparative steels 55–57 and 59 in which Nb, V and Ti were added in excess of the composition range of the present invention showed an unacceptable formability. This is due to the fact that the carbides produced within the steel lowered the formability.

The comparative steel 54 in which Cr was added in excess of the composition range of the present invention showed high strengths, but low elongation and formability. This is due to the fact that a large amount of α'-martensites were formed after the tensile deformation.

The comparative steel 61 in which nitrogen (N) was added in excess of the composition range of the present invention showed aggravated elongation and formability, and this is due to the fact that the nitrides were precipitated excessively.

<EXAMPLE 6>

The steel 44 of the present invention as shown in Table 4 of example 5 was hot-rolled and cold-rolled in the same way as in Example 5. Then the cold rolled steel sheet was annealed under the annealing condition of Table 5 below.

After carrying out the annealing, a microstructure inspection was carried out on the cold rolled steel sheets, and then, tensile tests were carried out to decide the yield strength, tensile strength and elongation. A cupping test using a punch of a 33 mm diameter was carried out to decide the formability, the result of these tests being shown in Table 5 below.

TABLE 5

| Steel Number | Annealing Conditions: Annealing Temp. | Annealing Conditions: Annealing period | Austenite Grain Size After Annealing (μm) | Tensile Test: Yield Strength (kg/m²) | Tensile Test: Tensile Strength (kg/m²) | Tensile Test: elongation (%) | Formability LDR value |
|---|---|---|---|---|---|---|---|
| Steel of the invention | | | | | | | |
| 62 | 600° C. | 20 sec. | 4 | 58.9 | 87.6 | 41.9 | 2.06 |
| | | 1 min. | 4 | 56.1 | 86.8 | 42.8 | 2.06 |
| | | 20 hrs. | 6 | 48.4 | 82.9 | 48.7 | 2.06 |
| 63 | 800° C. | 20 sec. | 10 | 40.8 | 77.7 | 53.5 | 2.06 |
| | | 1 min. | 10 | 40.0 | 78.9 | 51.5 | 2.06 |
| | | 20 hrs. | 15 | 39.9 | 78.4 | 51.7 | 2.06 |
| 64 | 900° C. | 20 sec. | 19 | 39.2 | 74.3 | 54.9 | 2.06 |
| | | 1 min. | 20 | 38.0 | 73.5 | 55.1 | 2.06 |
| | | 20 hrs. | 24 | 34.9 | 70.6 | 57.2 | 2.06 |
| 65 | 1000° C. | 20 sec. | 31 | 23.7 | 65.6 | 60.0 | 1.94 |
| | | 1 min. | 30 | 23.1 | 64.4 | 61.2 | 1.94 |
| | | 20 hrs. | 34 | 23.0 | 65.2 | 61.7 | 1.94 |
| Comparative steel | | | | | | | |
| 66 | 520° C. | 15 min. | — | 97.9 | 106.6 | 11.7 | 1.94 or less |
| | | 30 hrs. | — | 95.2 | 107.2 | 8.2 | " |
| 67 | 800° C. | 4 sec. | — | 94.4 | 107.8 | 7.4 | " |
| | | 30 hrs. | 28 | 24.2 | 67.3 | 32.8 | " |
| 68 | 1050° C. | 20 sec. | 53 | 20.1 | 56.2 | 57.7 | " |
| | | 1 min. | 53 | 20.4 | 57.0 | 50.4 | " |
| | | 20 hrs. | 57 | 21.8 | 56.4 | 53.6 | " |

As shown in Table 5, the steels 62–65 of the present invention which meet the annealing condition and the composition of the present invention have characteristics such that the austenite grain size after the annealing was reduced to below 40 μm, that the yield strength, the tensile strength and the elongation were high, and that the formability is superior.

On the other hand, the comparative steels 66–68, which meet the composition of the present invention, but which depart from the annealing conditions of the present invention, have the following characteristics. That is, in the case where the annealing temperature was lower than the annealing temperature range of the present invention, or where the annealing time was short, the austenitic structure was not recrystallized so as to give high strengths, but the elongation and the formability were too low. On the other hand, in the case where the annealing temperature was too high or where the annealing time was too long, the austenite grains was coarsened so as for the elongation to be bettered, but the formability was aggravated due to the formation of carbides within the steel.

<Example 7>

The steel 44 of the present invention and the conventional steel 38 as shown in Table 4 of Example 5 were hot-rolled and cold-rolled in the manner of Example 6, and then, an annealing was carried out at a temperature of 1000° C. for 15 minutes.

Then, on the annealed steel sheets, a spot welding was carried out with the condition of: a pressure of 300 kgf, a welding current of 10 KA, and a current conducting time of 30 cycles (60 Hz). Then hardness tests were carried out on the welded portion at the intervals of 0.1 mm with a weight of 100 g, the result of this test being illustrated in FIG. 6.

Figure 6:
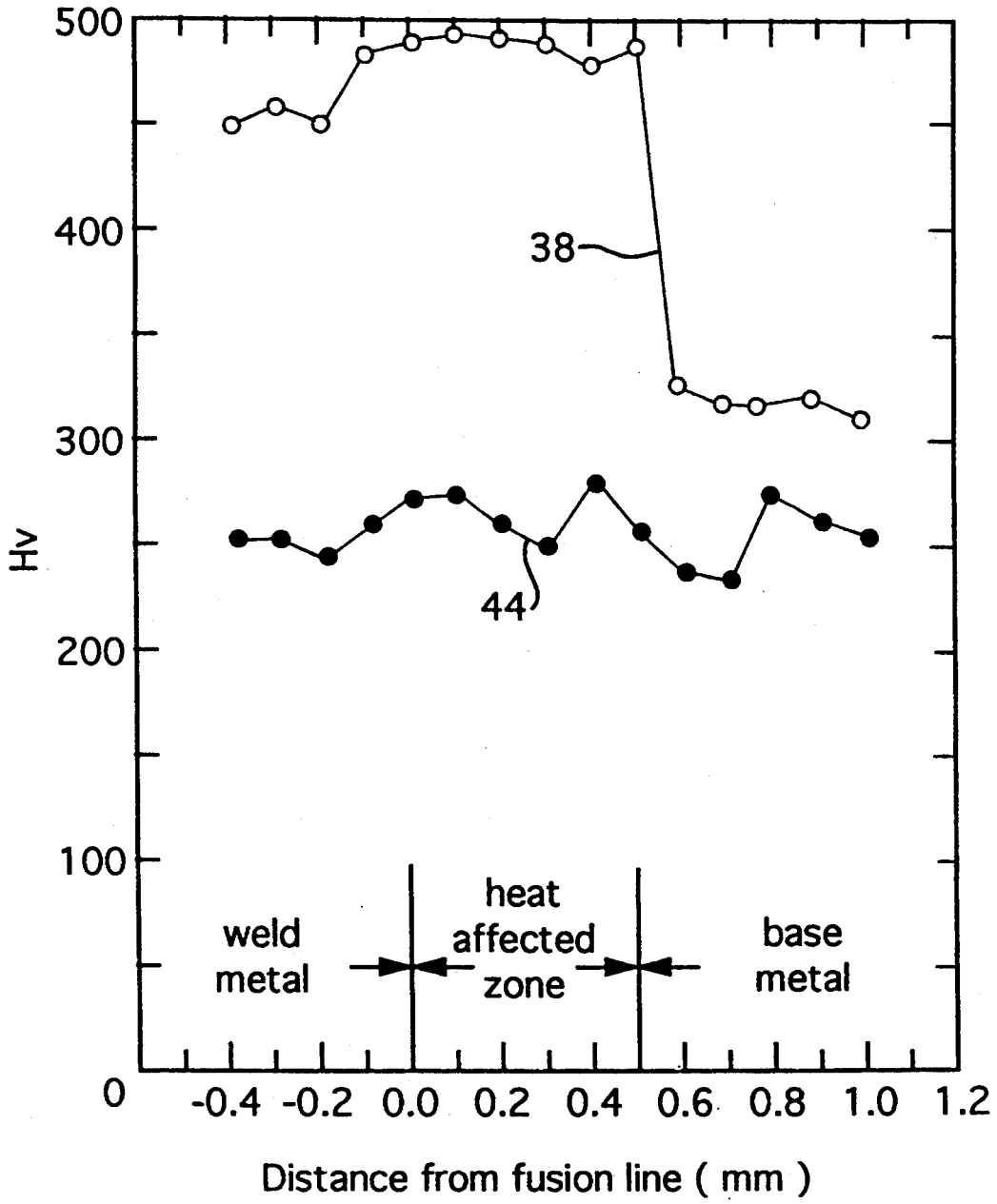
FIG. 6 is a graphical illustration showing the variation of a hardness on the welded joint based on the experiments.

As shown in FIG. 6, the weld metal, the heat affected zone and the base metal of the steel 44 of the present invention showed a vickers hardness value of 250 in all the three parts, and this is an evidence to the fact that the steel 44 of the present invention has a superior weldability.

The reason why the steel 44 of the present invention has such a superior weldability is that there is generated no brittle structure layer on the heat affected zone.

On the other hand, the conventional steel 38 showed that the weld metal and the heat affected zone had a vickers hardness value of about 500 which is much higher than the base material. This is an evidence to the fact that its weldability is an acceptable, brittle phases being formed on the weld metal and the heat affected zone.

According to the present invention as described above, the steel of the present invention has a tensile strength of 50–70 kg/mm² which is twice that of the extra low carbon steel. Therefore, the weight of the automobile can be reduced, and the safety of the automobile can also be upgraded. Further, the solubility limit is very high, and therefore, the carbon content can be increased to 1.5 weight %, so that no special treatment is needed, and that a special management for increasing the formability is not required in the process of cold rolling. Consequently, an austenitic high manganese steel having superior formability, strengths and weldability can be manufactured.

What is claimed is:

1. A process for manufacturing a high manganese austenitic steel having superior formability and strength for automotive structural applications, comprising the steps of:

preparing a steel slab having a composition consisting essentially of in weight %: less than 1.5% of C, 15.0–35.0% of Mn, 0.1–3.0% of Al, balance Fe, and other incidental impurities;

heating said steel slab to 1100°–1250° C.;

hot rolling said steel slab to form a hot rolled sheet with a hot rolling finishing temperature of 700°–1000° C.;

cold rolling the hot rolled sheet to form a cold rolled sheet; and annealing the cold rolled sheet at a temperature of 500°–1000° C. for five seconds to 20 hours to form a grain size of less than 40 μm, whereby upon subsequent plastic deformation at room temperature said annealed sheet is free from strain induced martensite and contains deformation twins and wherein said annealed sheet has an LDR value of greater than 1.94.

2. A process for manufacturing a high manganese austenitic steel having superior formability and strength for automotive structural applications, comprising the steps of:

preparing a steel slab having a composition consisting essentially of in weight %: less than 1.5% of C, 15.0–35.0% of Mn, 0.1–3.0% of Al, less than 0.25% of Si, less than 0.2% of N, balance Fe, and other incidental impurities;

heating said steel slab to 1100°–1250° C.;

hot rolling said steel slab to form a hot rolled sheet with a hot rolling finishing temperature of 700°–1000° C.;

cold rolling the hot rolled sheet to form a cold rolled sheet; and annealing the cold rolled sheet at a temperature of 500°–1000° C. for five seconds to 20 hours to form a grain size less than 40 μm, whereby upon subsequent plastic deformation at room temperature said annealed sheet is free from strain induced martensite and contains deformation twins and wherein said annealed sheet has an LDR value of greater than 1.94.

3. A process for manufacturing a high manganese austenitic steel having superior formability and strength for automotive structural applications, comprising the steps of:

preparing a steel slab having a composition consisting essentially of in weight %: less than 1.5% of C, 15.0–35.0% of Mn, 0.1–3.0% of Al, less than 0.25% of Si, less than 0.2% of N, less than 0.2% of Ti, balance Fe, and other incidental impurities;

heating said steel slab to 1100°–1250° C.;

hot rolling said steel slab to form a hot rolled sheet with a hot rolling finishing temperature of 700°–1000° C.;

cold rolling the hot rolled sheet to form a cold rolled sheet; and annealing the cold rolled sheet at a temperature of 500°–1000° C. for five seconds to 20 hours to form a grain size less than 40 μm, whereby upon subsequent plastic deformation at room temperature said annealed sheet is free from strain induced martensite and contains deformation twins and wherein said annealed sheet has an LDR value of greater than 1.94.

* * * * *

UNITED STATES PATENT AND TRADEMARK OFFICE

CERTIFICATE OF CORRECTION

PATENT NO. : 5,431,753

DATED : July 11, 1995

INVENTOR(S) : Tai W. Kim, Jae K. Han, Rae W. Chang and Young G. Kim

It is certified that error appears in the above-indentified patent and that said Letters Patent is hereby corrected as shown below:

Abstract Lines 7-8 "indispensable" should read --incidental--.

Column 1 Line 27 "a extra" should read --an extra--.

Column 2 Line 32 after "62-136557)" insert --.--.

Column 2 Line 37 after "inventors" delete ")".

Column 2 Line 65 "embodiment" should read --embodiments--.

Column 3 Line 20 "indispensable" should read --incidental--.

Column 3 Line 34 "indispensable" should read --incidental--.

Column 3 Line 43 "indispensable" should read --incidental--.

Column 3 Lines 52-53 "indispensable" should read --incidental--.

Column 3 Line 68-Column 4 Line 1 "indispensable" should read --incidental--.

Column 4 Line 1 "Slab" should read --slab--.

Column 4 Line 10 "e-martensites" should read --ϵ-martensites--.

UNITED STATES PATENT AND TRADEMARK OFFICE

CERTIFICATE OF CORRECTION

PATENT NO. : 5,431,753

DATED : July 11, 1995

INVENTOR(S) : Tai W. Kim, Jae K. Han, Rae W. Chang and Young G. Kim

It is certified that error appears in the above-indentified patent and that said Letters Patent is hereby corrected as shown below:

Column 4 Line 13 "( to" should read --(to--.

Column 4 Line 16 "carbin" should read --carbon--.

Column 4 Line 23 "come" should read --comes--.

Column 4 Line 49 "deoxidze" should read --deoxidize--.

Column 6 Line 1 "austentic" should read --austenitic--.

Column 6 Line 16 "coars carbides," should read --coarse carbides,--.

Column 6 Line 41 "Was" should read --was--.

Column 6 Line 59 "the each" should read --each--.

Column 6 Line 64 "uniformloy" should read --uniformly--.

Column 8, TABLE 1, under 'Volume fractions of the phases', "$\gamma$ (austenite" should read --$\gamma$ (austenite)--.

Column 8, TABLE 1, last heading, "Peameability" should read --Permeability--.

Column 7, TABLE 2, under 'Tensile Test, Tensile Strength ($kg/mm^2$)', across from 'Steel of the invention, 3', "59.8" should read --56.8--.

UNITED STATES PATENT AND TRADEMARK OFFICE

CERTIFICATE OF CORRECTION

PATENT NO. : 5,431,753

DATED : July 11, 1995

INVENTOR(S) : Tai W. Kim, Jae K. Han, Rae W. Chang and Young G. Kim

It is certified that error appears in the above-indentified patent and that said Letters Patent is hereby corrected as shown below:

Column 7, TABLE 2, under 'Tensile Test, elongation (%)', across from 'Steel of the invention, 6', "46.G" should read --46.6--.

Column 7 Lines 66-67 "departs" should read --depart--.

Column 8 Line 63 "and or" should read --and/or--.

Column 9 Line 26 "a extra" should read --an extra--.

Column 9 Line 41 "shows" should read --show--.

Column 9 Line 46 "a elongation" should read --an elongation--.

Column 10 Line 17 "test" should read --tests--.

Column 10, TABLE 3, move the row that appears after "Convent." down two lines to the row beginning with "38".

Column 12, TABLE 3-A-continued, under 'Volume fractions of the phases after the tensile tests, ∈-martensite', across from 'Comparative hot rolled sheet, 34', "13" should read -- - --.

Column 11 Line 17 "a elongation" should read --an elongation--.

UNITED STATES PATENT AND TRADEMARK OFFICE

CERTIFICATE OF CORRECTION

PATENT NO. : 5,431,753

DATED : July 11, 1995

INVENTOR(S) : Tai W. Kim, Jae K. Han, Rae W. Chang and Young G. Kim

It is certified that error appears in the above-indentified patent and that said Letters Patent is hereby corrected as shown below:

Column 12 Line 12 "to high" should read --too high--.

Column 12 Line 19 after "carried" insert --out--.

Column 12 Line 21 "elongazted" should read --elongated--.

Column 12 Line 24 "was" should read --were--.

Column 12 Line 24 "result" should read --results--.

Columns 11-12, TABLE 3-B, move the row that appears after "Convent." down two lines to the row beginning with "38".

Column 13 Line 13 "a extra" should read --an extra--.

Column 13 Line 21 "50-7-kg/mm$^2$," should read --50-7 kg/mm$^2$,--.

Column 13 Line 21 "a elongation" should read --an elongation--.

Column 14 Line 3 "a extra" should read --an extra--.

Column 14, TABLE 4, under 'Composition, Mn', across from 'Steel of the invention, 52', "35.0" should read --25.0--.

Column 15, TABLE 4-A, under 'Tensile Test, Tensile Strength (kg/mm$^2$)', across from 'Hot rolled steel sheet of the invention, 39', "93.4" should read --63.4--.

UNITED STATES PATENT AND TRADEMARK OFFICE

CERTIFICATE OF CORRECTION

PATENT NO. : 5,431,753

DATED : July 11, 1995

INVENTOR(S) : Tai W. Kim, Jae K. Han, Rae W. Chang and Young G. Kim

It is certified that error appears in the above-indentified patent and that said Letters Patent is hereby corrected as shown below:

Column 15 Line 34 "a elongation" should read --an elongation--.

Column 16 Line 68 "were" should read --was--.

Column 17, TABLE 4-B, under 'Steel Type, Comparative steel', the second occurrence of "60" should read --61--.

Column 17 Line 38 "a elongation" should read --an elongation--.

Column 17 Line 43 "a elongation" should read --an elongation--.

Column 17 Line 49 after "Ti" insert --,--.

Column 18 Line 61 "example 5" should read --Example 5--.

UNITED STATES PATENT AND TRADEMARK OFFICE

CERTIFICATE OF CORRECTION

PATENT NO. : 5,431,753

DATED : July 11, 1995

INVENTOR(S) : Tai W. Kim, Jae K. Han, Rae W. Chang and Young G. Kim

It is certified that error appears in the above-indentified patent and that said Letters Patent is hereby corrected as shown below:

Columns 19-20, TABLE 5, under 'Tensile Test', "Yield Strength ($kg/m^2$)" should read --Yield Strength ($kg/mm^2$)--.

Columns 19-20, TABLE 5, under 'Tensile Test', "Tensile Strength ($kg/m^2$)" should read --Tensile Strength ($kg/mm^2$)--.

Column 19 Line 49 "was" should read --were--.

Column 20 Line 40 "phases" should read --phase--.

Signed and Sealed this

Twelfth Day of December, 1995

*Attest:*

*Attesting Officer*

Bruce Lehman

BRUCE LEHMAN

*Commissioner of Patents and Trademarks*